US005295933A

United States Patent [19]

Ciminski et al.

[11] Patent Number: 5,295,933

[45] Date of Patent: Mar. 22, 1994

[54] QUICK RELEASE WEIGHT BAR CLAMP AND METHOD FOR USE

[76] Inventors: John A. Ciminski, 5108 W. Echo La., Glendale, Ariz. 85302; Verl E. Miller, 907 M Ave., Le Grande, Oreg. 97850

[21] Appl. No.: 901,175

[22] Filed: Jun. 18, 1992

[51] Int. Cl.[5] ..... A63B 21/075

[52] U.S. Cl. ..... 482/107; 24/270; 403/17; 403/374

[58] Field of Search ..... 482/107; 24/19, 24, 24/268, 270, 273; 403/17, 18, 373, 374, 347

[56] References Cited

U.S. PATENT DOCUMENTS

| | | | |
|---|---|---|---|
| 2,244,351 | 6/1941 | Venables | 482/107 |
| 3,177,551 | 4/1965 | Engman . | |
| 3,204,991 | 9/1965 | Hauk . | |
| 3,305,234 | 2/1967 | Cline et al. . | |
| 3,828,403 | 8/1974 | Perrin et al. | 24/270 |
| 4,054,394 | 10/1977 | Neuman | 403/344 |
| 4,111,575 | 9/1978 | Hoshino | 403/373 |
| 4,573,717 | 3/1986 | Peacolk | 24/270 |
| 4,585,367 | 4/1986 | Gall | 482/107 X |
| 4,619,545 | 10/1986 | Küttenbaum | 403/373 X |
| 4,639,979 | 2/1987 | Polson . | |
| 4,643,460 | 2/1987 | Lieberg . | |
| 4,646,398 | 3/1987 | Myhrman | 482/107 |
| 4,669,911 | 6/1987 | Lundgren et al. | 24/19 X |
| 4,761,092 | 8/1988 | Nakatani | 403/374 X |
| 4,817,944 | 4/1989 | Anderson et al. . | |
| 5,062,631 | 11/1991 | Dao et al. | 482/107 |

FOREIGN PATENT DOCUMENTS

| | | | |
|---|---|---|---|
| 3738360 | 5/1989 | Fed. Rep. of Germany | 482/107 |
| 2162076 | 1/1986 | United Kingdom | 482/107 |
| 2186500 | 8/1987 | United Kingdom | 482/107 |

*Primary Examiner*—Robert Bahr

*Attorney, Agent, or Firm*—Jordan M. Meschkow; Don J. Flickinger; Lowell W. Gresham

[57] ABSTRACT

A quick release clamp having two crescent halves coupled at one end by a hinge and a spreader spring at the opposite end. A cam follower is coupled to the spring end of the crescent halves and configured to receive a handle. A handle, containing a cam configured to engage the cam follower, which when parallel to the hinge does not engage the cam and the clamp is open, and when rotated a quarter turn engages the cam and closes the clamp.

8 Claims, 1 Drawing Sheet

QUICK RELEASE WEIGHT BAR CLAMP AND METHOD FOR USE

BACKGROUND OF THE INVENTION

1. Field of the Invention

This invention relates to clamping devices.

More particularly, the present invention relates to devices normally employed as clamps on generally cylindrical pipes or bars.

In a further and more specific aspect, the present invention relates to retaining weights on weightlifting and barbell devices.

2. The Prior Art

Devices which are used as clamps on pipes, bars, shafts and the like are well known in the art. Specifically, devices for retaining weights on a bar for weightlifting applications are well known. Generally, a bar is provided onto each end of which disk shaped weights are mounted alone or in combination. Each disk shaped weight has a hole through its center, through which the bar is inserted. The weight disks are prevented from sliding off the bar by a collar which is placed on the bar between the outermost weight disk and the end of the bar. There are a large variety of collars, each preventing the weight disks from moving.

When weightlifting devices of the barbell type are used, it is very important that the disk shaped weights are securely held on the bar. Considerable damage could occur if a weight disk were to become detached while the barbell was in use. Many of the prior art collars are secured to the bar with a screw extending through the collar. When the screw is tightened, it engages with the bar, locking the collar in place. While these clamps are generally effective, since the screw engages a very small area of the bar, it must be very tight to be adequately secured. This frequently makes the clamp difficult to remove, even when the screw has a lever to facilitate engaging and disengaging the collar. This may be a problem, since many times, a collar must be removed frequently so the weight configuration can be changed. This can occur because an exercise program requires different weights, or more than one person is using the barbell and each requires different weights.

It would be highly advantageous, therefore, to remedy the foregoing and other deficiencies inherent in the prior art.

Accordingly, it is an object of the present invention to provide a quick releasing clamp.

Another object of the present invention is to provide a barbell clamp which securely engages the bar, but is easily removed.

SUMMARY OF THE INVENTION

Briefly, to achieve the desired objects of the present invention in accordance with a preferred embodiment thereof, provided are two crescent halves, coupled by a hinge on one end, and a spring on the other. The spring coupling one end of the crescent halves together forces the clamp open, the crescent halve pivoting at the hinge coupling the ends opposite the spring.

Each clamp halve has a cam follower, which are configured to receive a handle. The handle is configured to engage the cam followers with a cam. As the handle is rotated, the cam engages the cam to the cam followers, forcing them together. The cam action overcomes the tension of the spring, closing the clamp halves. Rubberized lining on the interior of the clamp ensures a secure fit on a bar.

BRIEF DESCRIPTION OF THE DRAWINGS

The foregoing and further and more specific objects and advantage of the instant invention will become readily apparent to those skilled in the art from the following detailed descriptions of a preferred embodiment thereof, taken in conjunction with the drawings, in which.

DETAILED DESCRIPTION OF THE PREFERRED EMBODIMENT

Figures 1, 2, 3, 4, 5, 6:
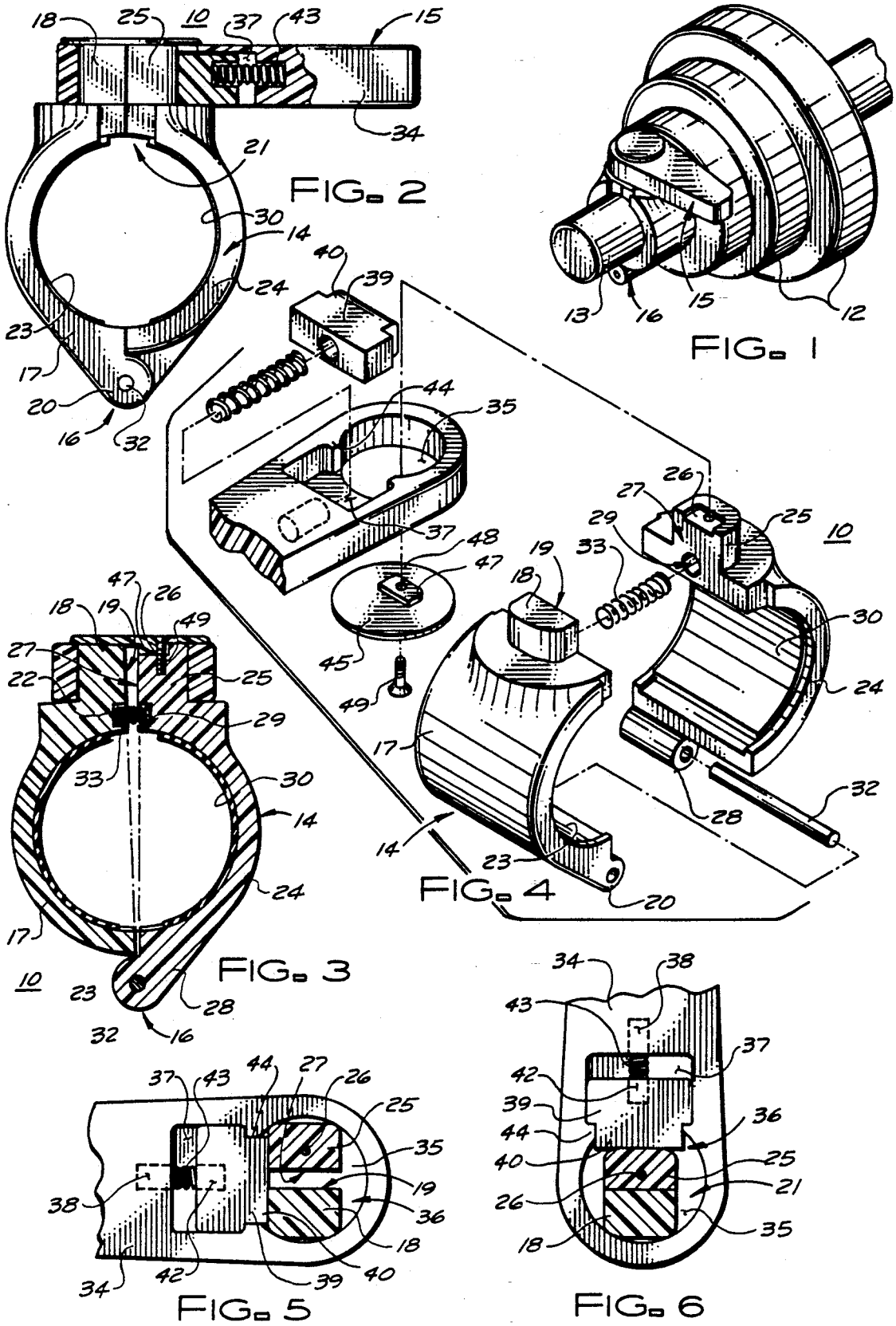
FIG. 1 is a perspective view of a clamp, constructed in accordance with the teachings of the instant invention, as it would appear engaged on a weight bar.
FIG. 2 is a top view of the present invention in a closed position, with a partial sectional view of the handle.
FIG. 3 is a sectional top view of the present invention in an open position.
FIG. 4 is a fragmentary perspective view of the present invention.
FIG. 5 is a cross sectional view of the handle cam and cam followers, in the open position.
FIG. 6 is a cross sectional view of the handle cam and cam followers, in the closed position.

Turning now to the drawings in which like reference characters indicate corresponding elements throughout the several views, attention is first directed to FIG. 1 which illustrates a quick release clamp generally designated 10, securely retaining disk shaped weights 12 to a bar 13. Clamp 10 fits over an end of bar 13 and is closed to secure weights 12. The number and size of weights 12 may vary to individual requirements It will be understood that a second end of bar 13 has a similar configuration of disk shaped weights 12 and a second quick release clamp 10 holding them on bar 13. Clamp 10 has two positions, an open position to allow clamp 10 to be placed on bar 13, and a closed position to secure it and weights 12 in position. These positions will be described fully below.

Referring now to FIG. 4, quick release clamp 10 is illustrated in a fragmentary view. Clamp 10 includes a collar 14 having two halves coupled by a hinge 16, and a handle 15 coupled thereto. Collar 14 consists of a first crescent half 17 having a cam follower half 18 extending perpendicularly outward from an end thereof. Cam follower half 18 is a generally rectangular pedestal having rounded corners and a planar face 19 immediately adjacent to, and flush with the open end of cam follower half 18. A first hinge half 20 of hinge 16 is coupled to and offset to the outer edge of the end of first crescent half 17 opposite cam follower half 18. First hinge half 20, in this embodiment, is generally tubular in shape, and extends parallel along half the end of first crescent half 17. A spring recess 22 extends into planar face 19 and a crescent liner 23 made of rubber or similar material is coupled to the inside of first crescent half 17.

Still referring to FIG. 4, collar 14 further consists of a second crescent half 24 having a cam follower half 25 extending perpendicularly outward from an en thereof. Cam follower half 25 is a generally rectangular pedestal having rounded corners and a planar face 27 immediately adjacent to, and flush with the open end of cam follower half 25. Cam follower half 25 has an inset screw hole 26 in the surface opposite the end of second crescent half 24 from which it extends. A second hinge half 28 of hinge 16 is coupled to and offset to the outer edge of the end of second crescent half 24 opposite cam follower half 25. Second hinge half 28, in this embodiment, is generally tubular in shape, and extends parallel along half the end of second crescent half 24 such that when first crescent half 17 is coupled to second crescent half 24 first hinge half 20 and second hinge half 28 align to form hinge 16, a continuous tube. A spring recess 29 extends into planar face 27 and a crescent liner 30 made of rubber or similar material is coupled to the inside of second crescent half 24.

Referring now to FIG. 3, first crescent half 17 is coupled to second crescent half 24 by placing the ends of each together such that planar faces 19 and 27 are adjacent and first hinge half 20 and second hinge half 28 form hinge 16. A hinge pin 32 extending through hinge halves 20 and 28 pivotally couples crescent halves 17 and 24. Cam follower halves 18 and 25, together forming a cam follower 21 which is generally rectangular in shape, are held slightly apart by a spreading spring 33 which extends into both spring recesses 22 and 29.

Referring back to FIG. 4, handle 15 consists of a handle body 34 with a generally circular cam opening 35 at one end, configured to engage cam follower halves 17 and 25. A substantially rectangular buffer space 37 is formed in handle body 34, contiguous with cam opening 35. A spring recess 38 is formed in the surface of buffer space 37, opposite cam opening 35. A rectangular buffer 39, having a buffer surface 40 extending from one end thereof and a spring recess 42 extending into the opposite end, fits wholly into buffer space 37. A compression spring 43 extends into both spring recesses 38 and 42, forcing buffer 39 towards cam opening 35, and causing buffer surface 40 to project into cam opening 35 forming a cam 36. Buffer 39 is retained in buffer space 37 with only buffer surface 40 extending into cam opening 35, by lips 44.

Handle 15 is couple to collar 14. Cam follower halves 18 and 25 extend into cam opening 35 as illustrated in FIG. 3. A cover plate 45 generally disk shaped and having a projection 47 through which a screw hole 48 extends, couples handle 15 to collar 14. Projection 47 is configured to engage inset screw hole 26 such that screw hole 26 and screw hole 48 align and cover plate 45 is immobile with respect to cam follower halves 18 and 25. A screw 49 extends through screw holes 48 and 26 securing cover plate 45 in place. Cover plate 45 covers cam follower 21 and its edges extend out over handle body 34 around cam opening 35. Cover plate 45 is stationary. With respect to cam follower half 25, and, while securely retaining it, allows handle 15 to rotate freely.

Referring to FIGS. 3 and 5, clamp 10 is illustrated in the open position. While in the open position, crescent halves 17 and 24 are slightly separated at planar faces 19 and 27 by the tension from spreading spring 33. As shown in FIG. 5, buffer surface 40 is pressed against both cam follower halves 18 and 25 by the tension from compression spring 43. This holds handle 15 in place, with the length of handle 15 parallel to spring halves 20 and 28. In this position, clamp 10 can be removed from or placed onto bar 13.

Referring now to FIG. 2, clamp 10 is illustrated in the closed position. When in the closed position, crescent halves 17 and 24 are together such that planar faces 19 and 27 are flush against one another. From the open position to the closed position, handle 15 is turned a quarter turn. To turn handle 15, the tension from compression spring 43 must be overcome. As handle 15 is turned, buffer surface 40 moves around cam follower halves 18 and 25 in a cam action. The rounded corners facilitate this action. As the tension from compression spring 43 is overcome, buffer 39 is pushed back into buffer space 37 by cam followers 18 and 25. As buffer surface 40 slips over the corners of cam followers 18 and 25, the tension from compression spring 43 forces buffer 39 towards cam opening 35. When handle 15 has turned a full quarter turn, buffer surface 40 is pressed against one of the cam follower halves 18 or 25.

As illustrated in FIG. 6, the tension from compression spring 43 forces buffer face 40 into cam opening 35 and against one of cam follower halves 18 or 25. Buffer surface 40 presses cam follower halves 18 and 25 between itself and the opposite wall of cam opening 35. This overcomes the smaller tension forces created by spreading spring 33, and crescent halves 17 and 24 are forced together. The tension formed by compression spring 43 is sufficient to close clamp 10 around a bar with sufficient clamping force to securely retain weight disks 12 on bar 13.

Various changes and modifications to the embodiment herein chosen for purposes of illustration will readily occur to those skilled in the art. To the extent that such modifications and variations do not depart from the spirit of the invention, they are intended to be included within the scope thereof which is to be assessed only by a fair interpretation of the following claims.

Having fully described the invention in such clear and concise terms as to enable one skilled in the art to understand and practice the same, the invention claimed is:

1. A quick release weight bar clamp comprising:
a collar having;
a first crescent half,
a second crescent half,
a hinge pivotally coupling a first end of said first crescent half to a first end of said second crescent half,
a spreader spring moveably coupling a second end of said first crescent half to a second of said second crescent half, said spreader spring biasing said second end of said first half away from said second end of said second half, and
a handle having;
a handle body, and
said handle body containing a cam configured to engage said cam follower, urging said second end of said first crescent toward said second end of said second crescent, compressing said spreader spring,
said cam follower extending into said cam;
a cover plate coupling said handle to said collar; and
a crescent liner coupled to the inside of said first crescent half and said second crescent half.

2. A device as claimed in claim 1 wherein said cam follower further comprises:
a first cam follower half extending perpendicularly outward from said second end of said first crescent half,
said first cam follower having a planar face adjacent to and flush with said second end of said first crescent half, a second cam follower half extending perpendicularly outward from said second end of said second crescent half, and said second cam follower having a planar face adjacent to and flush with said second end of said second crescent half.

3. A device as claimed in claim 2 wherein said cam further comprises:

a cam opening defined by one end of said handle body;

a buffer space defined by said handle body and contiguous with said cam opening;

a buffer;

a compression spring extending from one end of said buffer, coupling said buffer into said buffer space; and a buffer surface extending from an end of said buffer opposite said compression spring and projecting into said cam opening.

4. A weight lifting device comprising:

a bar;

at least one weight slideably mounted on a first end of said bar;

a quick release clamp mounted on said bar outwardly from said at least one weight; and said quick release clamp comprising:

a collar encircling said bar, having;

a first crescent half, a second crescent half, a hinge pivotally coupling a first end of said first crescent half to a first end of said second crescent half, a spreader spring moveable coupling a second end of said first crescent half to a second end of said second crescent half, said spreader spring biasing said second end of said first half away from said second end of said second half, and a cam follower extending perpendicularly from said second ends of said first and said second crescent halves, a handle having;

a handle body, and said handle body containing a cam configured to engage said can follower, urging said second end of said first crescent toward said second end of said second crescent, compressing said spreader spring, said cam follower extending into said cam;

a cover plate coupling said handle to said collar; and a crescent liner coupled to the inside of said first crescent half and said second crescent half.

5. A device as claimed in claim 4 wherein said cam follower further comprises:

a first cam follower half extending perpendicularly outward from said second end of said first crescent half;

said first cam follower having a planar face adjacent to and flush with said second end of said first crescent half;

a second cam follower half extending perpendicularly outward from said second end of said second crescent half; and said second cam follower having a planar face adjacent to and flush with said second end of said second crescent half.

6. A device as claimed in claim 4 wherein said cam further comprises:

a cam opening defined by one end of said handle body;

a buffer space defined by said handle body and contiguous with said cam opening;

a buffer;

a compression spring extending from one end of said buffer, coupling said buffer into said buffer space; and a buffer surface extending from an end of said buffer opposite said compression spring and projecting into said cam opening.

7. A device as claimed in claim 4 wherein at least one weight is slideably mounted on a second end of said bar and a second quick release clamp is mounted on said bar outwardly from said weight.

8. A method of suing said quick release clamp, comprising the steps of:

providing a bar;

providing at least one slideable weight;

providing a quick release clamp;

said quick release clamp comprising:

a collar encircling said bar, having;

a first crescent half, a second crescent half, a hinge pivotally coupling a first end of said first crescent half to a first end of said second crescent half, a spreader spring moveable coupling a second end of said first crescent half to a second end of said second crescent half, said spreader spring biasing said second end of said first half away from said second end of said second half, and a cam follower extending perpendicularly from said second ends of said first and said second crescent halves, a handle having;

a handle body; and said handle body containing a cam configured to engage said cam follower, urging said second end of said first crescent toward said second end of said second crescent, compressing said spreader spring, said cam follower extending into said cam;

a cover plate coupling said handle to said collar; and a crescent liner coupled to the inside of said first crescent half and said second crescent half;

placing at least one slideable weight on one end of said bar;

placing said quick release clamp on said bar, outwardly from said weight; and clamping said collar to said bar by rotating said handle on quarter turn.

* * * * *

UNITED STATES PATENT AND TRADEMARK OFFICE

CERTIFICATE OF CORRECTION

PATENT NO. : 5,295,933

DATED : 22 March 1994

INVENTOR(S) : John A. Ciminski, Verl E. Miller

It is certified that error appears in the above-identified patent and that said Letters Patent is hereby corrected as shown below:

Column 6, Line 24, "suing" should be --using--.

Column 6, Line 62, "on" should be --one--.

Signed and Sealed this

Twenty-third Day of August, 1994

*Attest:*

*Attesting Officer*

Bruce Lehman

BRUCE LEHMAN

*Commissioner of Patents and Trademarks*